US010285486B2

(12) United States Patent
Kang

(10) Patent No.: US 10,285,486 B2
(45) Date of Patent: May 14, 2019

(54) FOUNDATION CONTAINER HAVING DISCHARGING PUMP HAVING SHORT STROKE DISTANCE AND CONTENT DIFFUSION MEMBER

(71) Applicant: Sungil Kang, Seongnam-si (KR)

(72) Inventor: Sungil Kang, Seongnam-si (KR)

( * ) Notice: Subject to any disclaimer, the term of this patent is extended or adjusted under 35 U.S.C. 154(b) by 345 days.

(21) Appl. No.: 15/024,168

(22) PCT Filed: Sep. 23, 2014

(86) PCT No.: PCT/KR2014/008825
§ 371 (c)(1),
(2) Date: Mar. 24, 2016

(87) PCT Pub. No.: WO2015/046855
PCT Pub. Date: Apr. 2, 2015

(65) Prior Publication Data

US 2016/0227903 A1 Aug. 11, 2016

(30) Foreign Application Priority Data

Sep. 24, 2013 (KR) ..... 20-2013-0007876 U

(51) Int. Cl.
*A45D 40/00* (2006.01)
*A45D 34/00* (2006.01)
(Continued)

(52) U.S. Cl.
CPC ..... *A45D 40/0075* (2013.01); *A45D 33/006* (2013.01); *A45D 34/00* (2013.01);
(Continued)

(58) Field of Classification Search
CPC .. A45D 33/006; A45D 34/00; A45D 40/0075; A45D 40/22; B05B 11/3039; B05B 11/304
(Continued)

(56) References Cited

U.S. PATENT DOCUMENTS

2010/0170917 A1* 7/2010 Ki ..... A45D 34/00 222/256
2012/0305606 A1* 12/2012 Lee ..... A45D 33/02 222/256

FOREIGN PATENT DOCUMENTS

JP 05-023135 Y2 6/1993
KR 20-0370308 Y1 12/2004
(Continued)

*Primary Examiner* — Tatiana L Nobrega
*Assistant Examiner* — Jennifer F Gill
(74) *Attorney, Agent, or Firm* — Heedong Chae; Lucem, PC

(57) ABSTRACT

The present invention relates to a foundation container configured by an outer container main body (100) and an outer container lid (150) opened/closed while being hinge-coupled to the outer container main body (100), the foundation container having a discharge pump having a short stroke distance and a content diffusion member, the foundation container comprising: an inner container main body (300) formed inside the outer container main body (100); an auxiliary container (370) formed in the inner container main body (300) and configured to receive contents; an inner container lid (400) for covering the upper portion of the inner container main body (300); an inner container shielding plate (350) inwardly coupled to the upper portion of the inner container main body (300); a discharge pump (600) coupled to the central portion of the inner container shielding plate (350); a content diffusion member (700) coupled to the discharge pump (600); an impregnation member (800) coupled to the upper portion of the content diffusion member (700).

18 Claims, 13 Drawing Sheets

(51) Int. Cl.
*A45D 33/00* (2006.01)
*B05B 11/00* (2006.01)
*A45D 40/22* (2006.01)

(52) U.S. Cl.
CPC ..... *A45D 40/22* (2013.01); *B05B 11/3025* (2013.01); *B05B 11/3045* (2013.01); *A45D 2200/055* (2013.01); *A45D 2200/056* (2013.01); *B05B 11/00416* (2018.08)

(58) Field of Classification Search
USPC ..... 401/188 R; 132/299; 222/321.2
See application file for complete search history.

(56) References Cited

FOREIGN PATENT DOCUMENTS

| | | | |
|---|---|---|---|
| KR | 10-2012-0074880 | A | 7/2012 |
| KR | 20-0461424 | Y1 | 7/2012 |

* cited by examiner

-- PRIOR ART --

-- PRIOR ART --

-- PRIOR ART --

-- PRIOR ART --

FOUNDATION CONTAINER HAVING DISCHARGING PUMP HAVING SHORT STROKE DISTANCE AND CONTENT DIFFUSION MEMBER

CROSS-REFERENCE TO RELATED APPLICATION

This application claims the benefit of Korean Application No. 20-2013-0007876, filed on Sep. 24, 2013 with the Korean Intellectual Property Office, the disclosure of which is incorporated herein by reference.

TECHNICAL FIELD

The present invention relates to a foundation container having a discharge pump having a short stroke distance and a content diffusion member, and more particularly, to a foundation container having a discharge pump having a short stroke distance and a content diffusion member, in which a pump upper body, to which a discharge valve is installed, is vertically reciprocated in a pump main body to change the volume of a content temporary storage space so that the contents are pumped, and a content diffusion member is provided on a top end of the pump upper body such that contents are uniformly diffused in an impregnation member.

BACKGROUND ART

A compact container keeps powdered contents therein and the powdered contents sore used by using a puff. However, when the powdered contents are used, the contents may be scattered. In addition, when the powdered contents are applied on a face, the adhesion is deteriorated. Thus, gel-type foundation has been developed to overcome such defects. Due to its convenience, gel-type foundation has been increasingly used.

In general, cosmetics are manufactured by mixing mutually different materials having mutually different specific gravity, and the cosmetic materials may be classified into water-in-oil (W/O) emulsion type cosmetic material and oil-in-water (O/W) emulsion type cosmetic material obtained by mixing water-based material and oil-based material such as an emulsifying agent including a surface active agent.

The water-in-oil emulsion type cosmetic material has a larger quantity of oil than that of water and is oily, so skin absorption is slow. Although water-in-oil emulsion type cosmetic material feels heavy, their persistence is longer than that of the oil-in-water emulsion type cosmetic material. The oil-in-water emulsion type cosmetic material has a larger quantity of water than that of oil and is little oily, so skin absorption is fast. Although the touch feeling of the water-in-oil emulsion type cosmetic material is flash and light, the persistence is low. Therefore, the cosmetics requiring persistence are manufactured by using the W/O emulsion type cosmetic material to increase water resistance against sweat and water.

Although the touch feeling of the W/O emulsion type cosmetic material is heavy and sticky, the defects may be compensated by reducing the viscosity of content. However, when the water-in-oil product having low viscosity remains for a long time in circulation, the aqueous material of internal phase and the oil materials of external phase may separate from each other. In this case, a user shakes a container to mix the separated aqueous and oil materials with each other for use, but it is inconvenient to shake the container for use.

To solve the problems, as shown in FIG. 1, there has been disclosed a product in Korean Patent Unexamined Publication No. 10-2013-0001688, where water-in-oil contents having low viscosity are impregnated into an impregnation member to be contained in an airless pump container.

As shown in FIG. 1, the impregnation member 2000, in which the gel-type foundation is impregnated, is contained in a container main body 1000. To use the gel-type foundation impregnated into the impregnation member 2000, vacuum pressure is generated in the container main body 1000 through the pumping operation of the airless pump 4000 by pushing a push button 5000 so that a push plate 3000 at a lower portion of the container main body 1000 is lifted up. Thus, the impregnation member 2000, into which the gel-type foundation is impregnated, is compressed upward while being diminished by the push plate 3000, so that the gel-type foundation is discharged.

However, since the volume of the impregnation member 2000 is great, it is difficult for the push plate 3000 to fully lift up the impregnation member 2000 only by the pumping operation of the airless pump 4000. Therefore, it is difficult to fully use the gel-type foundation impregnated into the impregnation member 2000, so that the contents are wasted.

Thus, as shown in FIG. 2, to prevent the gel type foundation from being residual, there has been proposed a contact container having an airless pump in Korean Registered Utility Model No. 20-0461424.

Although the compact container having an airless pump prevents contents from being residual in a container main body 1000 by using the airless pump 4000, since the airless pump of the compact container according to the related art must use an operating piston 4200 and a sealing piston 4300 due to its structure, the stroke distance is long and, when the airless pump is installed in a flat container such as a compact, the airless pump must be manufactured to have a short stroke distance, so that the discharge amount at a time is small, so pumping must be performed several times to obtain a desired amount. In addition the structure of the airless pump 4000 is complex so that the manufacturing cost is increased.

For reference, the structure of the airless pump will be described as follows. As shown in FIGS. 3 and 4, the structure of the airless pump includes an opening/closing part 4120 for opening or closing the content introduction hole 4100 and the operating piston 4200 installed to receive the elastic force of the elastic member 4400. A cylinder is installed in the pump main body 4800 such that the operating piston 4200 presses the content storage room 4500 to allow the contents in the content storage room 4500 to be discharged through the push button 5000.

The sealing piston 4300 is additionally installed to the operating piston 4200 and a push button 5000 is installed to an operating tube 47000 coupled to the Operating piston 4200 of the cylinder 4600.

According to the content discharge pump of the related art having the above described configuration, when the push button 500 is pushed, after a pore is first created between the sealing piston 4300 and the operating piston 4200, the sealing piston 4300 and the operating piston 4200 move down together to generate pressure in a content storage room 4500, so that the contents are discharged through a content transfer path 4220 of the operating piston 4200 by the pressure.

In this case, an opening/closing part 4120 is tightly closed to a content introduction hole 4100 by a compressed elastic member 4400 to shut off the content introduction hole 4100.

After the push button 5000 is pushed to discharge the contents as described above, when the pressure on the push button 5000 is removed, as shown in FIG. 4, the operating piston 4200 and the sealing piston 4300 move up together by the repulsive elastic force accumulated in the elastic member 4400.

At the initial raising stage of the operating piston 4200 and the sealing piston 4300 described above, while the sealing piston 4300 is stopped due to the friction of the sealing piston 4300 and the inside of the cylinder 4600, the operating piston 4200 first moves up, so that the pore created between the operating piston 4200 and the sealing piston 4300 is closed, so that the content transfer path 4220 is shut off and the elastic force accumulated in the elastic member 4400 is weakened.

As described above, in the state that the content transfer path 4220 is shut off, as the operating piston 4200 and the sealing piston 4300 continuously move up by the elastic member 4400, vacuum pressure is generated in the content storage room 4500 and the opening/closing part 4120 is spaced apart from the content introduction hole 4100 by the vacuum pressure generated in the content storage room 4500, so that the contents in the container are introduced into the content storage room 4500.

The content discharge pump according to the related art repeats the above-described operation so that the contents are discharged.

However, the structure of the content discharge pump according to the related art is very complex so that the productivity is deteriorated and the product price is increased. In addition, since the stroke distance of the discharge pump is long due to its structure, when the discharge pump is applied to a product such as a compact, the height of which is less than the width thereof, the space in which the discharge pump is installed is small, so that it is difficult to install the discharge pump. When the discharge pump is manufactured in a small size to solve the problem, the discharge amount of contents is too small so that the pumping must be performed several times to obtain a desired amount of contents.

In addition, although the foundation container having an airless pump according to the related art prevents gel-type foundation from being residual therein, the foundation container does not have any foundations of suitably mixing the separated aqueous and oil materials of the gel-type foundation with each other. Thus, it is inconvenient in use because a consumer must shake the foundation container to mix the aqueous and oil materials with each other.

DISCLOSURE

Technical Problem

To solve the problems described above, an object of the present invention is to provide a foundation container easily operated in a short stroke distance pump, which includes a discharge pump having a short stroke distance such that a pump upper body, which a discharge valve is installed thereto, is vertically reciprocated in a pump main body to change the volume of a content temporary storage space to pump the contents.

Another object of the present invention is to provide a foundation container, which includes an impregnation member provided on an upper end of a discharge pump such that the separated aqueous and oil materials uniformly mixed with each other.

Still another object of the present invention is to provide a foundation container which is capable of uniformly mixing gel-type contents when the gel-type contents are discharged by an impregnation member, so that the foundation container is not required to be shaken for use.

Still another object of the present invention is to provide a foundation container, which includes a content diffusion member provided on an upper end of the discharge pump upper body to uniformly diffuse the contents on an impregnation member so that the contents having a uniform concentration may be used.

Still another object of the present invention is to provide a foundation container, which is capable of discharging gel-type contents by using a discharge pump so that the contents are prevented from being residual therein and which is capable of fully using the gel-type contents so that the contents are prevented from being wasted.

Still another object of the present invention is to provide a foundation container which includes a discharge pump having a simple structure that is easily manufactured to improve the productivity and reduce the product price.

Technical Solution

The present invention provides a foundation container, which includes a discharge pump having short stroke distance, a content diffusion member, an outer container main body (100), and an outer container lid (150) hinge-coupled to the outer container main body (100) to be opened or closed, which the foundation container includes an inner container main body formed in the outer container main body (100); a supplementary container (370) formed in the inner container main body (300) to contain contents; an inner container lid (400) for covering an upper part of the inner container main body (300); an inner container blocking plate (350) coupled to an upper inside of the inner container main body (300); the discharge pump (600) coupled to a center of the inner container blocking plate (350); a content diffusion member (700) coupled to the discharge pump (600); and an impregnation member (800) coupled to an upper part of the content diffusion member (700), wherein the discharge pump (600) includes a pump main body (10), a pump upper body (20), a pump lower body (30), an absorption valve plate (40), a discharge valve (50) and an elastic member (60).

When a top surface of the pump upper body (20) or the discharge valve (50) of the discharge pump (600) is pressed to move down the pump upper body (20), a volume of a temporary storage space (TR) is reduced to generate pressure in the temporary storage space (TR) so that the absorption valve plate closes a content absorption hole (32). A valve protrusion wheel (52) tightly closed to a content outlet (22) of an extension protrusion wheel (26) is opened by the pressure so that the contents in the temporary storage space (TR) pass through a gap formed between the content outlet (22) of the extension protrusion wheel (26) and the valve protrusion wheel (52). After the contents pass through a flowing path (24) which is a gap between the pump upper body (20) and the discharge valve (50), a discharge pressure is applied to an upper periphery part of the discharge valve (50) so that a gap is formed between an upper surface of the pump upper body (20) and the upper periphery part of the discharge valve (50) and the contents are discharged through the gap.

Removal of the applied pressure from the top surface of the pump upper body (20), or the discharge pump (50), causes the pump upper body (20) to move up due to the restoring force of the elastic member (60), which leads to the enlargement of the temporary storage space (TR) in the pump main body (10). This enlargement of the temporary storage space (TR) in the pump main body (10) generates vacuum pressure to close a gap between the valve protrusion wheel of the discharge valve (50) and the content outlet (22) of the extension protrusion wheel (26). A boundary line of an opening/closing line (41) cracks open while a central part of the absorption valve place (40) is lifted up due to the vacuum pressure such that the contents in the supplementary container (370) are delivered into the temporary storage space (TR) while passing through a gap between the absorption valve plate (40) and the content absorption hole (32). The contents passing through the content absorption hole (32) are delivered into the temporary storage space (TR) through a gap of the opening/closing line (41) of the absorption valve plate (40). When the vacuum pressure in the temporary storage space (TR) is removed due to the moving of the contents, the cracked opening/closing line (41) is restored to an original state thereof and closed due to elastic force of the absorption valve plate (40) so that the absorption valve plate (40) closes the content absorption hole (32).

Additionally, the inner container main body (300) may be integrated with the outer container main body (100).

Additionally, a sealing ring (360) may be further coupled to an outer peripheral surface of the inner container blocking plate (350) to enhance sealing strength.

Additionally, and preferably, a fixing member (330) is coupled to an upper side of the inner container main body (300) to prevent the inner container blocking plate (350), the content diffusion member (700) and an impregnation member from being separated from each other.

Additionally, the inner container lid (400) may be provided at an upper part thereof with a puff keeping space (410). A puff lid (420) is coupled to the upper part of the inner container lid (400).

Additionally, and preferably, a puff (900) is kept in the puff keeping space (410) of the inner container lid (400).

Advantageous Effects

According to the foundation container provided with a discharge pump having a short stroke distance and a content diffusion member of the present invention, the pump upper body, to which the discharge valve is installed, is vertically reciprocated in the pump main body to change the volume of the content temporary storage space so that the contents are pumped.

In addition, according to the foundation container of the present invention, the impregnation member is provided on an upper end of a discharge pump such that the separated aqueous and oil materials are uniformly mixed with each other.

In addition, according to the foundation container of the present invention, the gel-type contents may be uniformly mixed with each other when the gel-type contents are discharged by an impregnated member, so that the foundation container may be conveniently used because the foundation container is not required to be shaken for use.

In addition, according to the foundation container of the present invention, the content spreading member is provided on an upper end of the discharge pump to uniformly spread the contents over an impregnated member so that the contents having a uniform concentration may be used.

In addition, according to the foundation container of the present invention, since the discharging gel-type contents is discharged by the discharge pump, the contents may be prevented from being residual therein, so that the gel-type contents may be fully used, thereby preventing the contents from being wasted.

In addition, according to the foundation container of the present invention, since the discharge pump has a single structure, the discharge pump may be easily manufactured, so that the productivity may be improved and the product price may be reduced.

DETAILED DESCRIPTION OF THE INVENTION

Hereinafter, a foundation container including a contents diffusion member and a discharge pump having a shorter stroke according to the embodiment of the present invention will be described with reference to the accompanying drawings.

Figure 1:
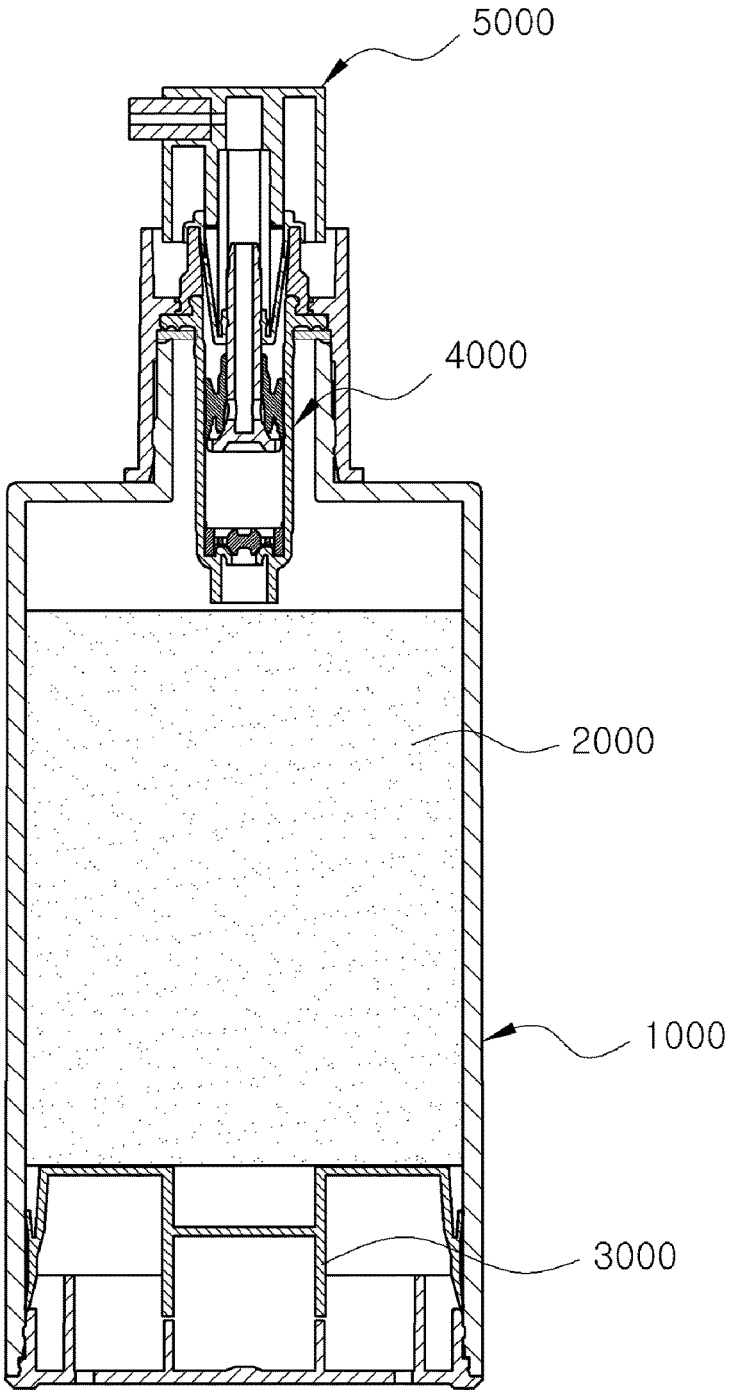
FIG. 1 is a sectional view of a cosmetic container having an impregnated member according to the related art.
Figure 2:
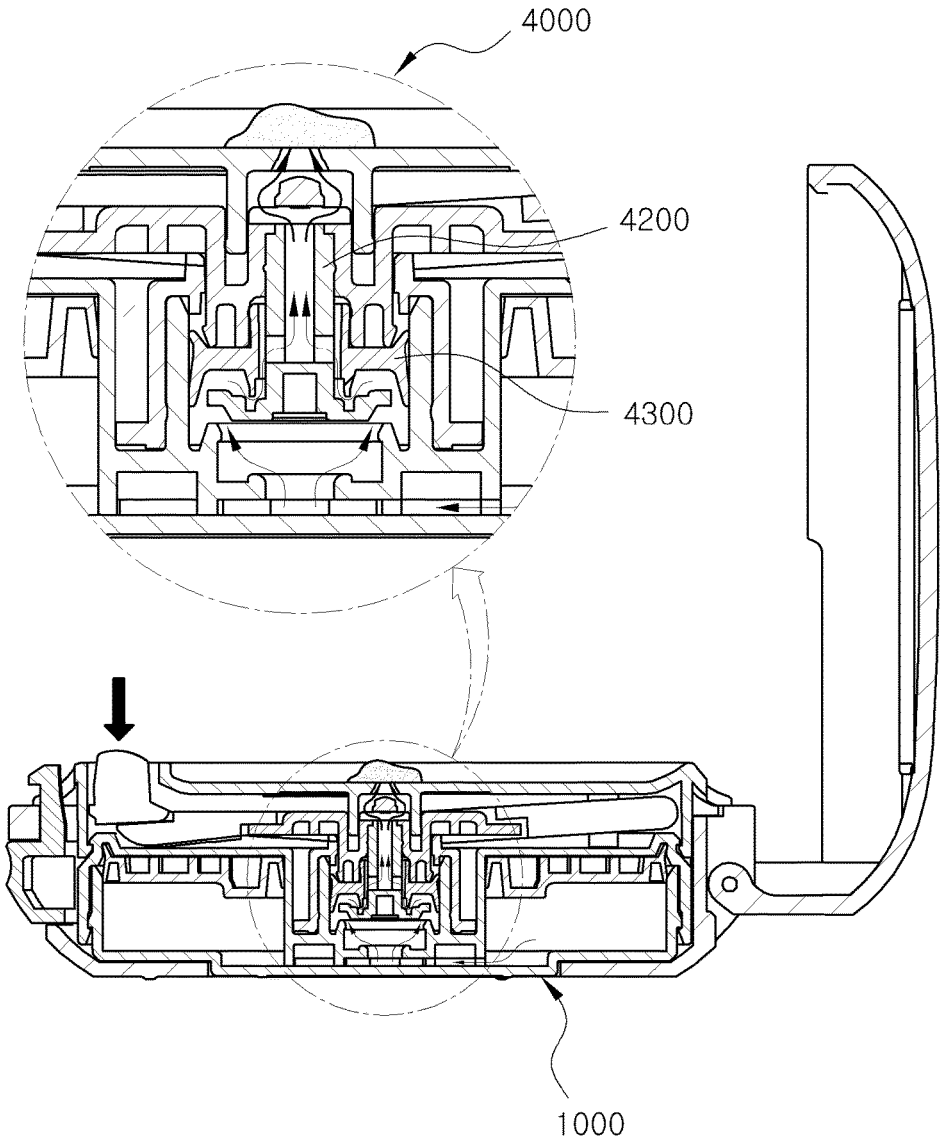
FIG. 2 is a sectional view showing a compact container having an airless pump according to the related art.
Figure 3:
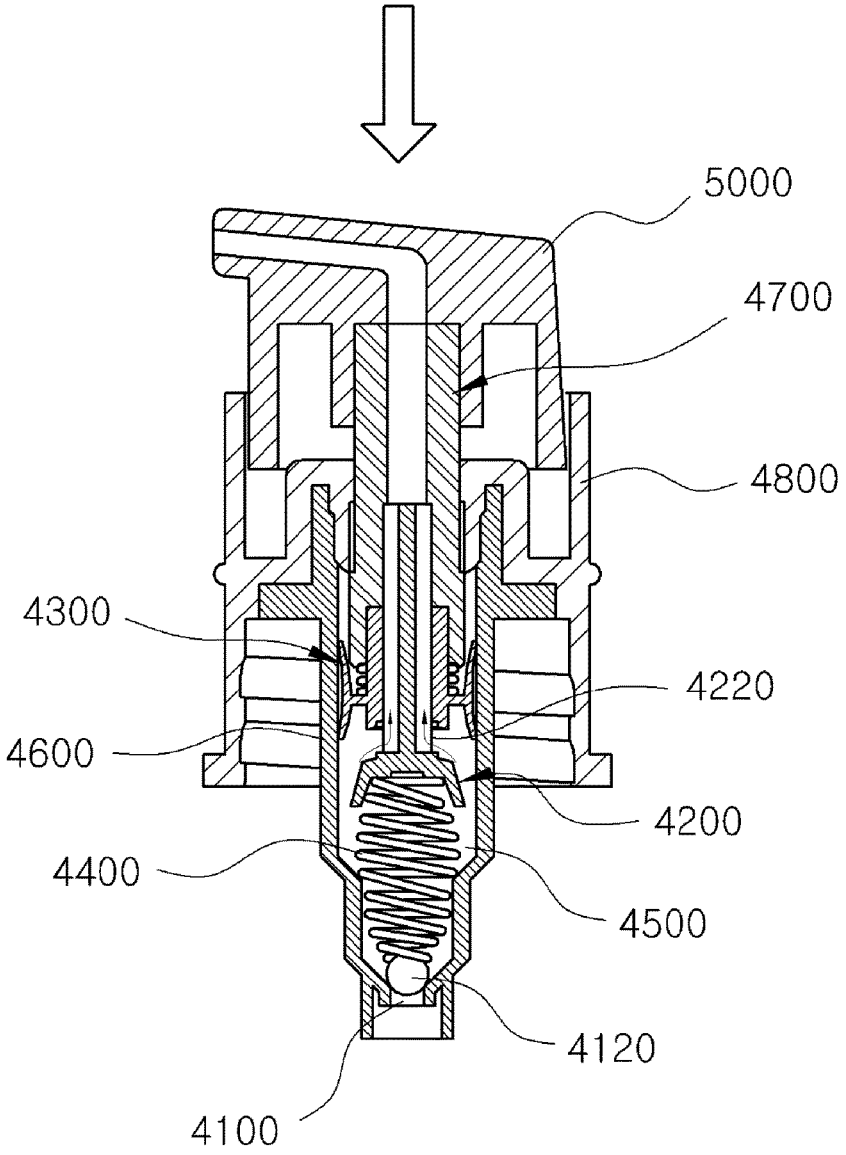
FIG. 3 is an exemplary view showing a state that contents are discharged by operating a content discharge pump according to the related art.
Figure 4:
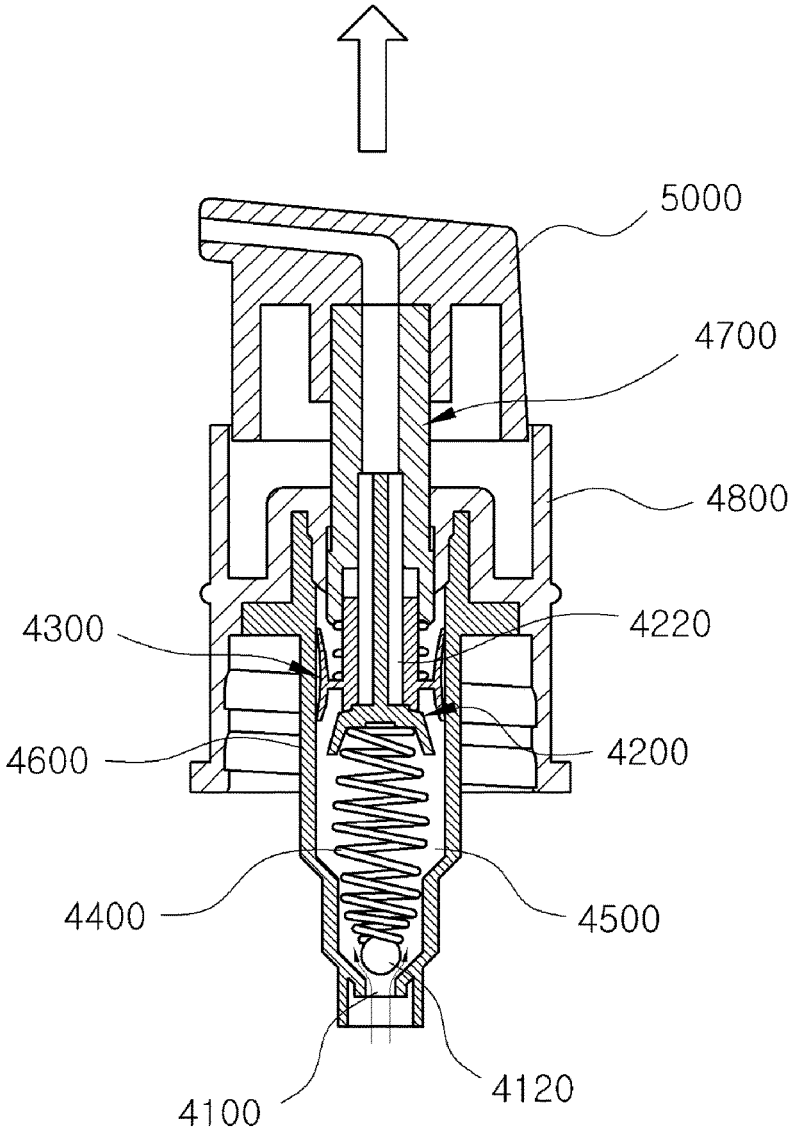
FIG. 4 is an exemplary view showing a state that a content discharge pump is restored to an original state when pressure on the content discharge pump is removed according to the related art.
Figure 5:
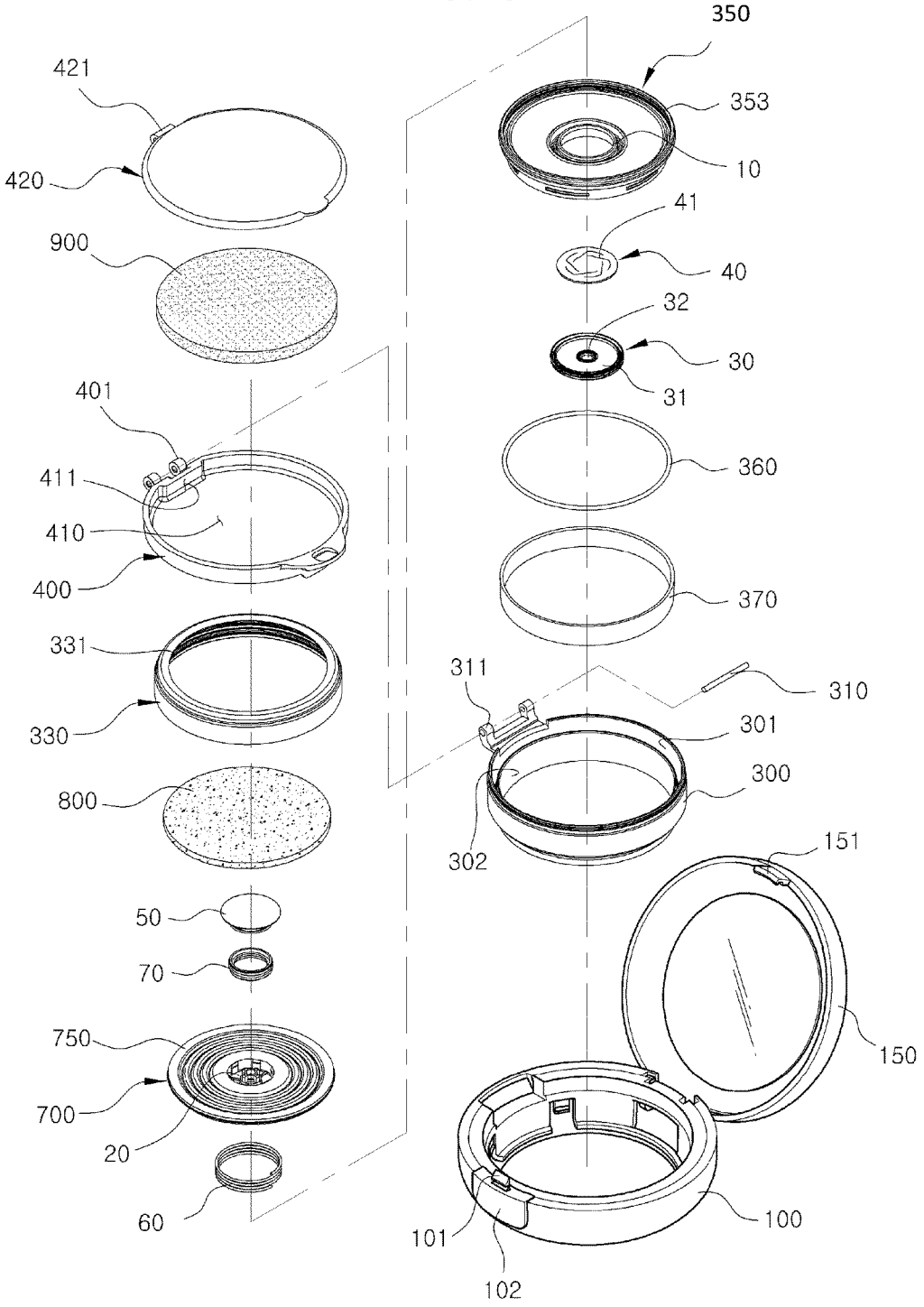
FIG. 5 is an exploded perspective view of a foundation container according to the present invention.
Figure 6:
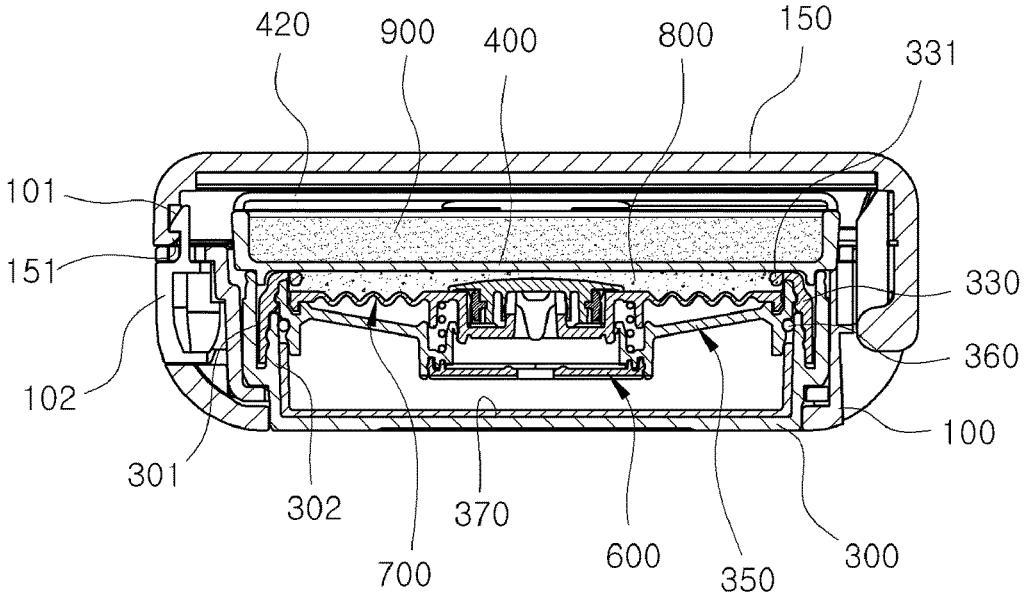
FIG. 6 is a sectional view showing an entire foundation container according to the present invention.

According to the present invention as shown in FIGS. 5 and 6, the foundation container, which includes an outer container body 100 and an outer container lid 150 hinged with the outer container body 100 to be open or closed, further includes an inner container body 300 formed in the outer container body 100; an auxiliary container 370 formed in the inner container body 300 to receive contents; an inner container lid 400 to cover an upper portion of the inner container body 300; an inner container blocking plate 350 coupled to an inside of an upper portion of the inner container body 300; a discharge pump 600 coupled to the center of the inner container blocking plate 350; a contents diffusion member 700 coupled to the discharge pump 600; and an impregnation member 800 coupled to an upper portion of the contents diffusion member 700, in which the discharge pump 600 includes a pump body 10, a pump upper body 20, a pump lower body 30, a suction valve plate 40, a discharge valve 50, and an elastic member 60.

Figure 7:
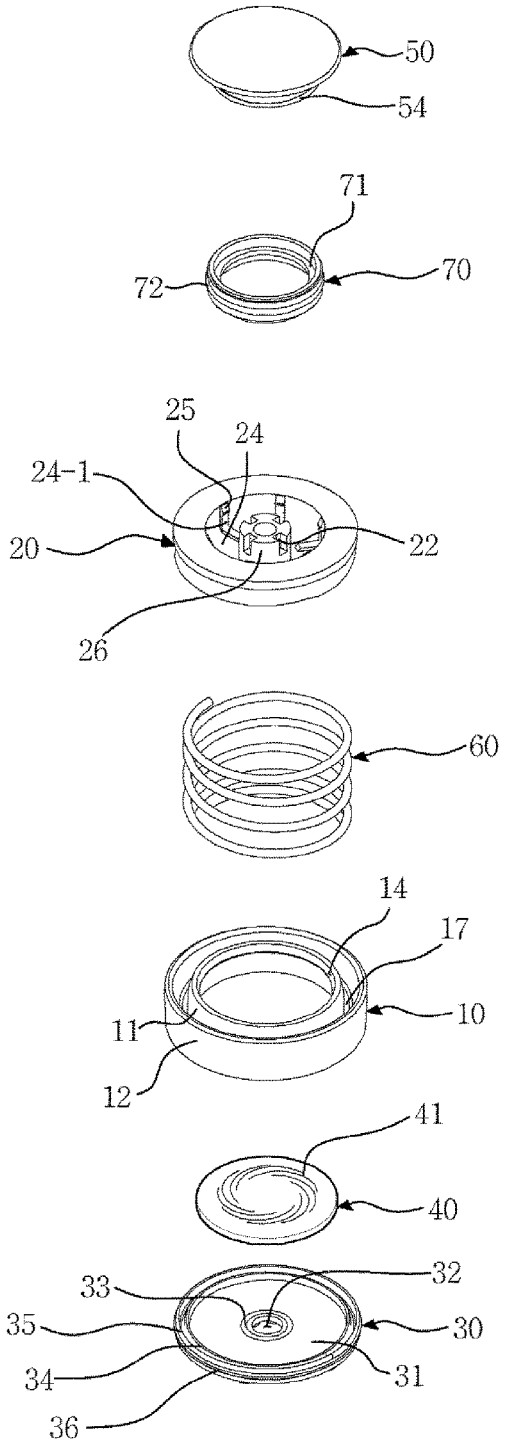
FIG. 7 is an exploded perspective view of a foundation container according to the present invention.
Figure 8:
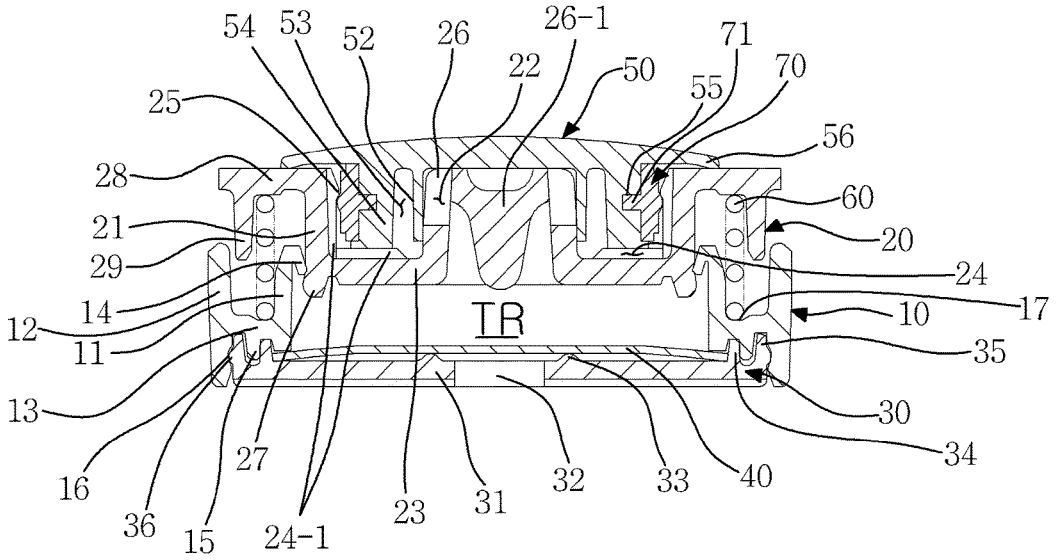
FIG. 8 is a sectional view showing a discharge pump of a foundation container according to the present invention.

In the discharge pump 600 of FIGS. 7 and 8, if the pump upper body 20 or a top surface of the discharge valve 50 is pressed so that the pump upper body 20 is moved down, the volume of a temporary storage TR in the pump body 10 is reduced, so that the pressure is increased in the temporary storage TR. Accordingly, the suction valve plate 40 closes a contents suction port 32, a valve protrusion wheel 52 contacting the contents discharge port 22 spreads due to the pressure such that the contents in the temporary storage TR pass though the spread space between the contents discharge port 22 of an extension protrusion wheel 26 and the valve protrusion wheel 52. Then, the contents pass through a passage 24 that serves as a gap between the pump upper body 20 and the discharge valve 50. Then, discharge pressure acts on the upper periphery of the discharge valve 50 to spread a gap between the upper surface of the pump upper body 20 and the upper peripheral edge of the discharge valve 50 so that the contents are discharged through the gap.

If the force applied to the upper surface of the pump upper body 20 or the discharge valve 50 is removed, vacuum pressure is generated when the space of the temporary storage TR in the pump main body 10 becomes larger as the pump upper body 20 is moved up by the restoring force of the elastic member. When the pump upper body 20 is moved up, the space between the valve protrusion wheel 52 of the discharge valve 50 and the contents discharge port 22 of the extension protrusion wheel 26 is closed, and the central portion of the suction valve plate 40 is moved up due to the vacuum force. Accordingly, the boundary of an open/close line 41 is opened to permit the contents to move to the temporary storage TR through the space between the suction valve plate 40 and the contents intake port 32. If the vacuum pressure disappears from the temporary storage TR according to the movement of the contents, the open/close line, which is opened due to the self-elasticity of the suction valve plate 40, is recovered to an original state and closed, so that the suction valve plate 40 closes the contents suction port 32.

Additionally, the inner container body 300 may be formed integrally with the outer container body 100.

Further, a sealing ring 360 may be further attached to the outer circumferential surface of the inner container blocking plate 350 to enhance sealing force.

Preferably, a fixture 330 is coupled onto the inner container body 300 to prevent the inner container blocking plate 350, the contents diffusion member 700, and the impregnation member 800 from being separated from the inner container body 300.

A puff built-in space 410 may be formed in the upper portion of the inner container lid 400 according to the present invention, and a puff cover 420 may further be formed on the inner container lid 400.

Additionally, and preferably, a puff 900 is received in the puff built-in space 410 of the inner container lid 400 according to the present invention.

The outer container body 100 receives the inner container body 300 therein, and the button 102 may be separated from a hook 151 of the outer container lid 150 as a user presses the button 102 so that a locking protrusion 101, which extends upward from the button 102, is easily moved back.

The outer container lid 150, which covers the upper portion of the outer container body 100, is hinged with the outer container body 100 to open or close the outer container body 100.

The outer container lid 150 is formed at one side thereof with the hook 151, and the hook 151 has the shape of a protrusion corresponding to the locking protrusion 101.

The inner container body 300 is provided therein with an auxiliary container 370, and the auxiliary container 370, which receives contents therein, has a thin thickness and includes a deformable material.

The auxiliary container 370 may include one of vinyl, synthetic resin material, ordinary rubber, elastomer, silicon rubber, or NBR rubber.

The auxiliary container 370 may be formed through a double injection process together with the inner container body 300. The auxiliary container 370 and the inner container body 300 are separately formed and assembled together.

The present invention will be described based on the structure in which the auxiliary container 370 is formed separately from the inner container body 300 and assembled with the inner container body 300 below.

The inner container body 300 includes an outer wall 301, an inner wall 302, and a hinge bracket 311 for the coupling with the inner container lid 400.

Although the inner container body 300 may be formed integrally with the outer container body 100, the following description will be made while focusing on the inner container body 300 according to the present invention.

The outer wall 301 and the inner wall 302 form the lateral sides of the inner container body 300, and a predetermined space is formed between the outer wall 301 and the inner wall 302.

The hinge bracket 311 is formed on one lateral side of the outer wall 301 for the hinge-coupling with the inner container lid 400 to cover the inner container body 300, and coupled to the outer wall 301 by a hinge pin 310.

The inner container blocking plate 350 is located on the upper end of the inner container body 300 and formed at the center of the inner container blocking place 350 is a pump body 10 to prevent the leakage of the contents.

The inner container blocking plate 350 is formed in an upper end thereof with a coupling groove 353, and a coupling protrusion 753 formed at an end of a diffusion plate 750 of the contents diffusion member 700 is fitted into the coupling groove 353, thereby preventing the diffusion plate 750 from being moved.

The inner container blocking plate 350 may be formed integrally with the pump body 10, or may be formed separately from the pump body 10.

The following description will be described while focusing on the structure that the inner container blocking plate is formed integrally with the pump body according to the present invention.

The pump body 10 is formed at the center of the inner container blocking plate 350 to serve as a cylinder of the pump. A hollow formed in the center of the pump body 10 serves as the temporary storage T in which contents stay until being discharged after sucked.

The sealing ring 360 may be further coupled to the outer peripheral surface of the inner container blocking plate 350 to enhance sealing force.

The sealing ring 360 may include one of ordinary rubber, elastomer, silicon rubber, NBR rubber, or synthetic resin material having excellent elasticity.

The discharge pump 600 includes the pump body 10, the pump upper body 20, the pump lower body 30, the suction valve plate 40, the discharge valve 50, and the elastic member 60.

The pump body 10 has an inner sidewall 11 penetrating through the top and bottom to form a hollow at the center of the inner sidewall 11. A connecting piece 13 is integrally formed at the center of an outside of the inner sidewall 11 and a bending wheel 14 is integrally formed with an inside of the upper side of the inner sidewall 11.

The pump body 10 is located at the center of the inner container blocking plate 350 and may be integrally formed with the inner container blocking plate 350, or may be formed separately from the inner container blocking plate 350. The following description will be made while focusing on the structure that the pump body 10 is formed integrally with the inner container blocking plate 350 according to the present invention.

The inner sidewall 11 serves a cylinder of a pump, and the hollow formed in the center of the pump body 10 serves as the temporary storage TR.

The connection piece 13 serves as a support on which an elastic member 69 is placed, and an outer sidewall 12 may be further formed at the outside of the connection piece 13.

The outer sidewall 12 may be utilized as an auxiliary unit for coupling the pump lower body 30 to a lower portion of the pump body 10.

The bending protrusion wheel 14 protruding inward from the upper portion of the inner sidewall 11 maintains air tightness when a vertical wall 21 of the pump upper body 20 is fitted into the pump body 10 and vertically moved. Preferably, an inner diameter of the bending protrusion wheel 14 is equal to or less than outer diameter of the vertical wall 21 of the pump upper body 20. Most preferably, when the inner diameter of the bending protrusion wheel 14 is 0.01 mm-0.5 mm less than the outer diameter of the vertical wall 21 of the pump upper body 20, the air tightness is maintained while the pump upper body 20 may be easily moved up and down in the pump body 10.

Alternatively, if the vertical wall 21 of the pump upper body 20 is larger than the inner diameter of the bending protrusion wheel 14 that is fitted into the pump body 10, then the bending protrusion wheel 14 is bent outward to receive elastic force so that the bending protrusion wheel 14 has the air tightness with respect to the vertical wall 21 of the pump upper body 20.

A sealing protrusion wheel 15 may be further formed downward of the connection piece 13. The sealing protrusion wheel 15 adds sealing force in the coupling with the pump lower body 30. Additionally, a coupling groove 16 is formed inward of a lower end of the outer sidewall 12 to serve as a unit for the coupling with the pump lower body 30. Although only the under-cut coupling between the pump body 10 and the pump lower body 30 is shown in accompanying drawings, the present invention is not limited thereto.

The connection piece 13 is formed therein with an elastic member mounting groove 17 so that the elastic member 60 may be securely mounted in the elastic member mounting groove 17.

The pump main body 10 is formed of synthetic resin, and preferably formed of polyethylene (PE).

The pump upper body 20 has the vertical wall 21 fitted into the inner sidewall 11 of the pump body 10 and is moved up and down, the extension protrusion wheel 26 formed at the center thereof with the contents discharge port 22, and a lower portion of the vertical wall 21 that is integrally coupled with the extension protrusion wheel 26.

Since the pump upper body 20 is fitted into the inner sidewall 11 of the pump body 10, and the bending protrusion wheel 14 is formed at the upper end of the inner sidewall 11 of the pump body 10, the vertical wall 21 of the pump upper body is fitted into the bending protrusion wheel 14 of the pump body 10 and is moved up and down. Since the inner diameter of the bending protrusion wheel 14 is equal to or less than outer diameter of the vertical wall 21, the pump upper body 20 is moved up and down in the pump body 10 while maintaining the air tightness.

A locking protrusion wheel 27 protrudes from an outer peripheral surface of a lower end of the vertical wall 21. Accordingly, when the pump upper body 20 is moved up in the pump body 10, the bending protrusion wheel 14 of the pump body 10 is locked to the locking protrusion wheel 27 of the pump upper body 20, thereby preventing the pump upper body 20 from being separated from the pump body 10.

An upper extension piece 28 is integrally formed with an upper end of the vertical wall 21 while extending outward of the upper end of the vertical wall 21, so that the elastic member 60 is elastically supported to a bottom surface of the upper extension piece 28. An outer auxiliary wall 29 may be further integrally formed with an outer end of the upper extension piece 28 while extending downward of the outer end of the upper extension piece 28. The outer auxiliary wall 29 prevents the elastic member 90 from deviating from the outside.

Additionally, when the pump upper body 20 is moved down, a lower end of the outer auxiliary wall 29 makes contact with the connection piece 13 of the pump body 10 to control the pump upper body 20 not to be moved down any more.

The extension protrusion wheel 26 is formed therein with a contents discharge port 22. An outer portion of the extension protrusion wheel 26 is closely covered with the valve protrusion wheel 52 of the discharge valve 50, so that the valve protrusion wheel 52 prevents contents from being discharged out through the contents discharge port 22 in ordinary time.

A contents guide rod 26-1, which has a streamline-shaped surface, is formed inside the extension protrusion wheel 26 so that contents may be smoothly moved toward the contents discharge port 22.

Protrusions 24-1 are formed on the side surface of a lower connecting plate 23 of the pump body 20 and an inner surface of the vertical wall 21 to form the passage 24 in the space between protrusions 24-1 so that contents may flow. A locking step 25 protrudes from the upper end of the protrusion 24-1 and is locked with the discharge valve 50.

The pump upper body 20 is formed of synthetic resin, and preferably formed of polyethylene (PE).

The pump lower body 30 is fitted and coupled to the lower side of the pump body 10, and the contents suction port 32 is formed in the center of a blocking plate **31*b*. An annular projection 33 protrudes from the upper portion of the blocking plate 31 while surrounding the outer side of the contents suction port 32 to increase the degree of adhesion with the suction valve plate 40**.

A coupling protrusion wall 35 is formed on an outer peripheral surface of the pump lower body 30 and is fitted between the outer wall 12 of the pump body 10 and the sealing protrusion wheel 15. Additionally, a coupling protrusion wheel 36 protrudes from an outer lateral side of the coupling protrusion wall 35, wherein the coupling protrusion wheel 36 is fitted into the coupling groove 16 of the pump body 10.

A sealing protrusion wheel 34 may be further formed inside the coupling protrusion wall 35 while being spaced apart from the coupling protrusion wall 35 by a predetermined distance. The sealing protrusion wheel 34 of the pump lower body 30 is coupled with the sealing protrusion wheel 15 of the pump body 10 to increase the sealing force.

Although the coupling of the pump lower body 30 has been described as being the under-cut coupling between the coupling protrusion wheel 36 and the coupling groove 16, the present invention is not limited thereto. In other words, the coupling of the pump lower body 30 may include various manners of coupling, such as press-fitting, thermal-fitting, or coupling by adhesive.

The pump lower body 30 is formed of synthetic resin, such as being preferably formed of polyethylene (PE).

The suction valve plate 40 is provided in the form of a plate and is coupled between the pump body 10 and the pump body 10. Several open/close lines 41 are formed in the suction valve plate 40.

The internal space defined by the pump body 10, the pump upper body 20, and the suction valve plate 40 serves as the temporary space TR where contents stay until the contents are discharged after being sucked.

The suction valve plate 40 may include one of ordinary rubber, elastomer, silicon rubber, NBR rubber, or synthetic resin. Among them, NBR rubber is superior in terms of functionality and air tightness.

The open/close line 41 may be a corrugated cutout line, an arc-shaped cutout line, an oblique cutout line, or a linear straight cutout line. The open/close line 41 may take on various shapes as long as the open/close line 41 can be opened and closed by the elasticity of the suction valve plate 40.

The discharge valve 50 is coupled to the upper portion of the pump body 20 and has a valve protrusion wheel 52 that opens and closes the contents discharge port 22 of the pump body 20. A coupling protrusion wheel 54 protrudes out of the valve protrusion wheel 52 for the coupling of the pump upper body 20.

The discharge valve 50 may be directly coupled to the pump body 20 by the coupling protrusion wheel 54 and may be coupled with the pump upper body 20 by a coupling assisting member 70.

The coupling assisting member 70 is fitted to the outside of the coupling protrusion wheel 54 of the discharge valve 50 and locked to a locking step 25 of the pump upper body 20.

To this end, the coupling assisting member 70 has a coupling protrusion wheel 71 that protrudes inwardly for the coupling with the discharge valve 50, and a coupling groove 55 is formed in an outer portion of the coupling protrusion wheel 54 of the discharge valve 50, so that the coupling protrusion wheel 71 of the coupling assisting member 70 is coupled to the coupling groove of the discharge valve 50.

A locking protrusion 72 protrudes from the outer peripheral surface of the coupling assisting member 70 to be undercut-coupled with the locking protrusion 25 of the pump upper body 20. According to the embodiment of the present invention, the coupling assisting member 70 has been described as being undercut-coupled to the pump upper body 20, but the present invention is not limited thereto.

When the discharge valve 50, to which the coupling assisting member 70 is coupled, is coupled to the pump upper body 20, the bottom surface of the coupling wheel 54 of the discharge valve 50 makes contact with the protrusions of the pump upper body 20, which is horizontally located. In addition, the outer surface of the coupling assisting member 70 makes contact with the protrusion 24-1 of the pump upper body 20, which is vertically located. In this case, the passage 24 is formed to serve as a space where the contents flow between the protrusion 24-1 and an adjacent protrusion 24-1.

The discharge valve 50 may include one of ordinary rubber, elastomer, silicon rubber, NBR rubber, or synthetic resin. Among them, NBR rubber exhibits excellent characteristics in terms of functionality and air tightness.

The elastic member 60 is located between the pump body 10 and the pump upper body 20 to elastically support the pump upper body 20.

The elastic member 60 may include one of a synthetic resin material, elastomer, a rubber material, or a metal material.

Hereinafter, the assembling method of the discharge pump 600 applied to the foundation container according to the present invention having the above configuration will be described.

The suction valve plate 40 and the pump body 10 are assembled under the pump body 10. In detail, after bringing the edge of the suction valve plate 40 into close contact with the lower end of the inner sidewall 11 of the pump body 10, the coupling protrusion wall 35 of the pump lower body 30 is interposed between the outer sidewall 12 of the pump body 10 and the sealing protrusion wheel 15 of the pump body 10. At this time, the pump lower body 30 is assembled with the pump body 10 while being pressed against the pump body 10 so that the coupling wheel 36 of the pump lower body 30 is coupled with the coupling groove 16 of the pump body 10. In this case, the sealing protrusion wheel 34 of the pump lower body 30 makes close contact with the sealing protrusion wheel 15 of the pump body 10 while being offset from the sealing protrusion wheel 15 of the pump body 10 to increase the sealing force.

When the pump body 10 is assembled with the suction valve plate 40 and the pump lower body 30 in the same manner, the edge of the suction valve plate 40 is pressed and fixed between the lower end of the inner sidewall 11 of the pump body 10 and the top surface of the pump lower body 30. The central portion of the suction valve plate 40 makes close contact with an annular protrusion part 33 of the pump lower body 30 to maintain air tightness.

Next, after the elastic member 60 is placed in the elastic member mounting groove 17 formed in the upper portion of the connection piece 13, the pump upper body 20 is fitted into the pump body 10. In this case, the pump upper body 20 is press-fitted into the pump body 10 so that the vertical wall 21 of the pump upper body 20 is inserted into the bending protrusion wheel 14 of the pump body 10.

In this case, the locking protrusion wheel 27 formed on the outer peripheral surface of the lower end of the vertical wall 21 in the pump upper body 20 is inserted into the bending protrusion wheel 14 of the pump body 10 while pressing the bending protrusion wheel 14 of the pump body 10 outward. Once the vertical wall 21 of the pump upper body 20 is inserted into the bending protrusion wheel 14 of the pump body 10, the locking protrusion wheel 27 of the pump upper body 20 is locked to the bending protrusion wheel 14 of the pump body 10, thereby preventing the pump upper body 20 from being the pump body 10.

When the pump upper body 20 is assembled with the pump body 10 as described above, the elastic member 60 is elastically supported between the pump upper body 20 and the pump body 10, and is not exposed out by the outer auxiliary wall 29 of the pump upper body 20 and the outer sidewall 12 of the pump body 10.

Subsequently, the discharge valve 50 is assembled with the upper portion of the pump upper body 20. According to the present invention, description has been made in that the discharge valve 50 is assembled with the pump upper body 20 using the coupling assisting member 70.

Since the coupling assisting member 70 has a ring shape, the coupling assisting member 70 is fitted around the coupling protrusion wheel 54. The discharge valve 50 is formed of a rubber material exhibiting excellent elasticity, and a space 53 is formed inside the coupling protrusion wheel 54. Accordingly, the coupling protrusion wheel 54 is pressed inward and deformed while the coupling assisting member 70 is fitted around the coupling protrusion wheel 54 of the discharge valve 50. In this case, the coupling protrusion wheel 71 of the coupling assisting member 70 is fitted into the coupling groove 55 of the discharge valve 50.

Then, the discharge valve 50, already fitted into the coupling assisting member 70, is press-fitted into the upper portion of the pump upper body 20 in such a manner that the locking step 72 of the coupling assisting member 70 passes the locking step 25 formed on the protrusion 24-1 of the pump upper body 20.

In this case, since the valve protrusion wheel 52 of the discharge valve 50 is covered on the extension protrusion wheel 26 of the pump upper body 20 to make close contact with the extension protrusion wheel 26, the valve protrusion wheel 52 seals the contents discharge port 22 formed in the extension protrusion wheel 26.

In addition, the upper outer peripheral surface of the discharge valve 50 makes close contact with the top surface of the extension protrusion wheel 26 of the pump upper body 20. When the sealing protrusion wheel 56 is further formed on the upper outer peripheral surface of the discharge valve 50, the sealing protrusion wheel 56 makes close contact with the top surface of the upper extension piece 28 of the pump upper body 20.

The contents diffusion member 700 is coupled to the discharge pump 600, and includes the pump upper body 20 and a diffusion plate 750 extending from the upper extension piece 28 of the pump upper body 20.

The diffusion plate 750 of the contents diffusion member 700 may be formed integrally with the pump upper body 20 of the discharge pump 600. Alternatively, the diffusion plate 750 of the contents diffusion member 700 is formed separately from the pump upper body 20 of the discharge pump 600, and coupled to the pump upper body 20 of the 600 after assembling with the pump upper body 20.

The following description will be made while focusing on the structure that the diffusion plate 750 of the contents diffusion member 700 is formed integrally with the pump upper body 20 of the discharge pump 600 according to the present invention.

The contents diffusion member 700 discharges contents through the contents discharge port 22 of the pump upper body 20.

According to the first embodiment of the present invention, the diffusion plate 750 extends from the upper extension piece 2B of the pump upper body 20, and includes a protrusion 751, a recess 752, and a coupling protrusion 753.

Figure 11:
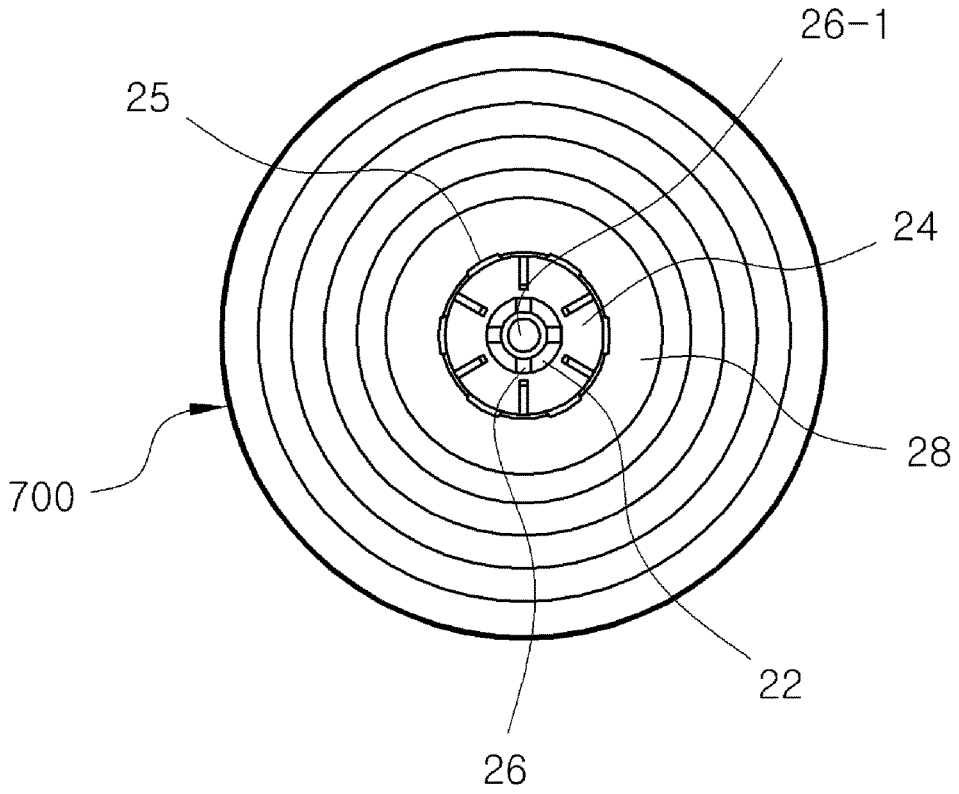
FIG. 11 is a plan view of a content diffusion member of a foundation container according to the present invention.
Figure 12:
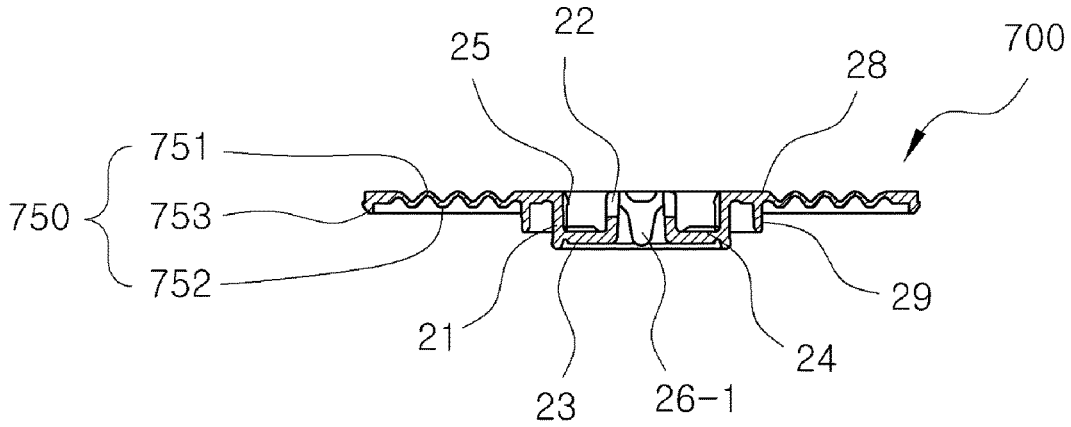
FIG. 12 is a sectional view of a content diffusion member of a foundation container according to the present invention.
Figure 13:
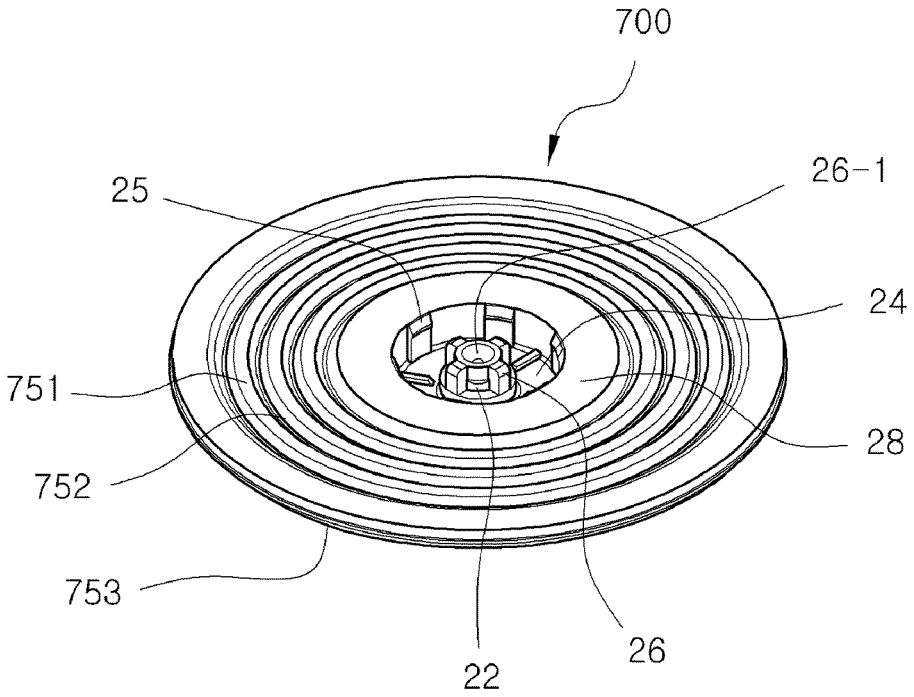
FIG. 13 is a perspective view of a content diffusion member of a foundation container according to the present invention.

The protrusion 751 and the recess 752 have circular shapes based on the pump upper body 20. As shown in FIGS. 11 to 13, the protrusion 751 and the recess 752 are repeatedly formed.

The coupling protrusion 753 protrudes downwardly from a point where the protrusion 751 and the recess 752 are terminated, and is fitted into the coupling groove 353 formed in the upper end of the inner container blocking plate 350, thereby preventing the diffusion plate 750 from being moved.

Contents discharged through the contents discharge port 22 of the pump upper body 20 are placed in the recess 752 of the protrusion 751 and the recess 752, which are repeatedly formed around the pump upper body 20, and impregnated in the impregnation member 800.

Figure 14:
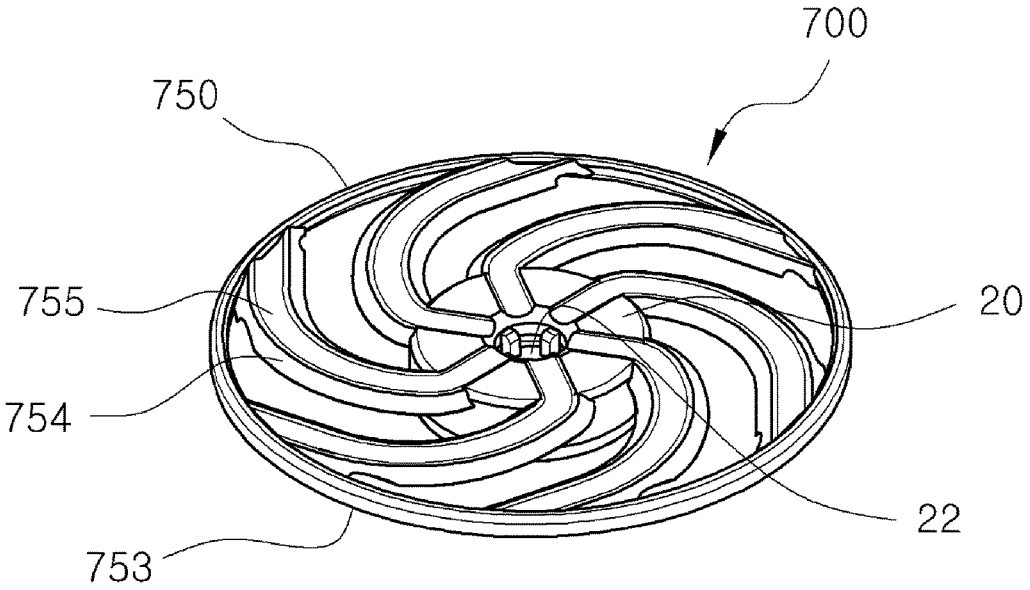
FIG. 14 is a view of a content diffusion member of a foundation container according to another embodiment of the present invention.

According to the second embodiment, as shown in FIG. 14, the diffusion plate 750 extends from the upper expansion piece 28 of the pump upper body 20 and is formed therein with a diffusion passage 755 through which the contents may be diffused.

The coupling protrusion 753 protrudes downward of the edge of the diffusion plate 750, and is fitted into the coupling groove 353 formed in the upper end of the inner container blocking plate 350, thereby preventing the diffusion plate 750 from being moved.

Contents discharged through the contents discharge port 22 of the pump upper body 20 widely flow out through the diffusion passage 755 in a contents passage plate 754 and is impregnated into the impregnation member 800.

The impregnation member 800 is coupled to an upper portion of the contents diffusion member 700 and is uniformly impregnated with the contents as the contents are spread around by the protrusion 751 and the recess 752 formed in the diffusion plate 750 of the contents diffusion member 700.

The impregnation member 800 is an open cell type foam, and the gel-phase contents are not separated from the impregnation member 800 by the surface tension of the foam.

The impregnation member 800 may be formed of at least one selected from the group consisting of butadiene rubber (BR), styrene butadiene rubber (SBR), natural rubber (NR), wet urethane, dry urethane, polyether, polyester, polyvinyl chloride, polyethylene, ethylene vinyl acetate (EVA), latex, silicon, styrene isoprene styrene (SIS), styrene ethylene butylene styrene (SEBS), polyvinyl alcohol (PVA), silicone elastomer, nitrile rubber, butyl rubber and neoprene.

As shown in FIG. 6, the fixture 330 is fixedly fitted between the outer wall 301 and the inner wall 302 of the inner container body 300, thereby preventing the deviation of the inner container blocking plate 350, the contents diffusion member 700, and the impregnation member 800.

A locking annular protrusion 331 formed at an upper end of the fixture 330 presses an upper end of the impregnation member 800 so that the impregnation member 800 is not moved.

A hinge bracket 401 is formed at one side of the inner container lid 400, and a hinge bracket coupling unit 411 is formed inside the hinge bracket 401. The inner container lid 400, which seals the inner container body 300, is provided therein with the puff built-in space 410 to store the puff 900 which is a cosmetics tool.

The hinge bracket 401 is coupled to the hinge protrusion 421 of the puff cover 420 to cover the inner container lid 400.

The hinge bracket coupling unit 411 is coupled with the hinge bracket 311 of the inner container body 300, and the inner container body 300 is coupled to the inner container lid 400 to seal the inner container body 300.

The puff 900 is located in the puff built-in space 410 of the contents container lid 400 and is formed of cotton, fabric, foamed NBR, ruby cell, polyester or the like so that the user does not have a sense of heterogeneity when the puff 900 comes into contact with the skin, or the puff 900 may be formed of sponge having flexibility or soft urethane foam.

The hinge protrusion 421 is formed at one side of the puff cover 420, and hinged with the inner container cap 400.

The hinge protrusion 421 is fitted into the hinge bracket 401 of the inner container lid 420 and fixedly hinged with the hinge bracket 401.

Hereinafter, the assembling method and the use state of the foundation container including the contents diffusion member and the discharge pump having the shorter stroke according to the embodiment of the present invention will be described with reference to accompanying drawing.

In order to assemble the foundation container including the contents diffusion member and the discharge pump having the shorter stroke, the inner container body 300 (having an auxiliary container 370) is fitted into a lower end of the outer container body 100 and contents are injected into the auxiliary container 370 as shown in FIG. 6.

Figure 10:
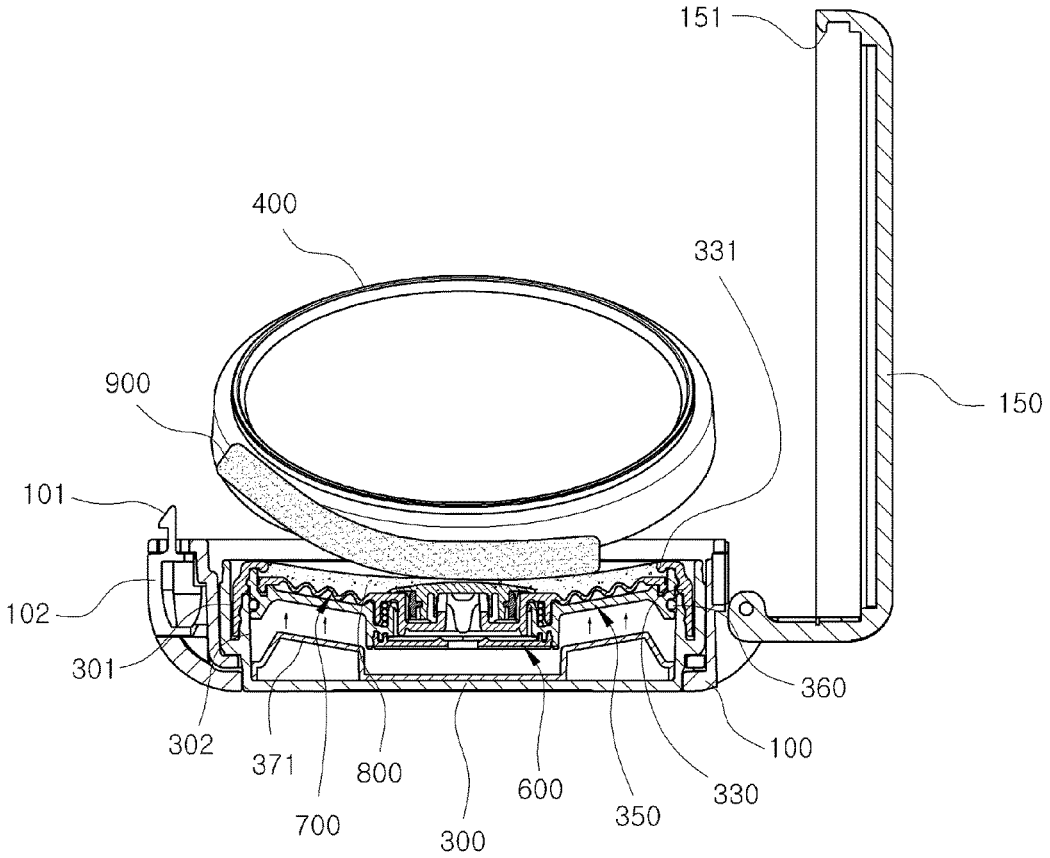
FIG. 10 is a view showing a using state of a foundation container according to another embodiment of the present invention.

According to another embodiment of the present invention, as shown in FIG. 10, after the inner container body 300 having a plate 371 is fitted into the lower end of the outer container body 100, the contents are injected into the auxiliary container 370.

Then, the inner container blocking plate 350 is fixedly mounted on the inner container body 300 to seal the inner container body 300. The sealing ring may be further coupled to the outer peripheral surface of the inner container blocking plate 350 to enhance sealing force.

Thereafter, after forming the discharge pump 600 at the center of the inner container blocking plate 350, the contents diffusion member 700 is coupled to the upper portion of the pump upper body 20 of the discharge pump 600. Then, the impregnation member 800 is coupled to the upper portion of the contents diffusion member 700.

In order to prevent the deviation of the inner container blocking plate 350, the contents diffusion member 700, the impregnation member 800, and the fixture 330 are mounted; the inner container lid 400 is hinged with the inner container body 300; and the puff 900 is provided in the puff built-in space 410 of the inner container cap 400.

Then, the puff cover 410 is hinged with the inner container cap 400, thereby completing the assembly of the foundation container including the contents diffusion member and the discharge pump having the shorter stroke according to the embodiment.

In order to use contents contained in the foundation container including the contents diffusion member and the discharge pump having the shorter stroke, the impregnation member 800 is pressed using the puff 900. As the impregnation member 800 is pressed, and if the contents diffusion member 700 and the discharge pump 600 are moved down, the pump upper body 20 of the discharge pump 600 is moved down such that the volume of the temporary storage TR is reduced while the pressure is increased in the temporary storage TR. Accordingly, the suction valve plate 40 closes the contents suction port 32, and the valve protrusion wheel 52, making close contact with the contents discharge port 22, is spread by the pressure of contents discharging from the temporary storage TR while the contents pass through the spread gap between the contents discharge port 22 and the valve protrusion wheel 52.

Thereafter, after the contents pass through the passage 24 (a gap between the pump upper body 20) and the discharge valve 50, discharge pressure acts on the upper periphery of the discharge valve 50 to spread the gap between the upper surface of the pump upper body 20 and the upper peripheral edge of the discharge valve 50 so that the contents are discharged through the gap.

In this case, the sealing protrusion 56 of the upper peripheral part of the discharge valve 50 is moved up while the contents are discharged through the gap formed when the sealing protrusion is moved up.

If the pressure is removed, the pump upper body 20 is moved up due to the restoring force of the elastic member 60 and the temporary storage TR in the pump body 10 is enlarged, which generates vacuum pressure. Due to the vacuum pressure, the space between the valve protrusion wheel 52 of the discharge valve 50 and the contents discharge port 22 is closed, and the central portion of the suction valve plate 40 is moved up. Accordingly, the boundary of an open/close line 41 is opened, which allows the contents contained in the auxiliary container 370 to move to the temporary storage TR through the space between the suction valve plate 40 and the contents intake port 32.

Figure 9:
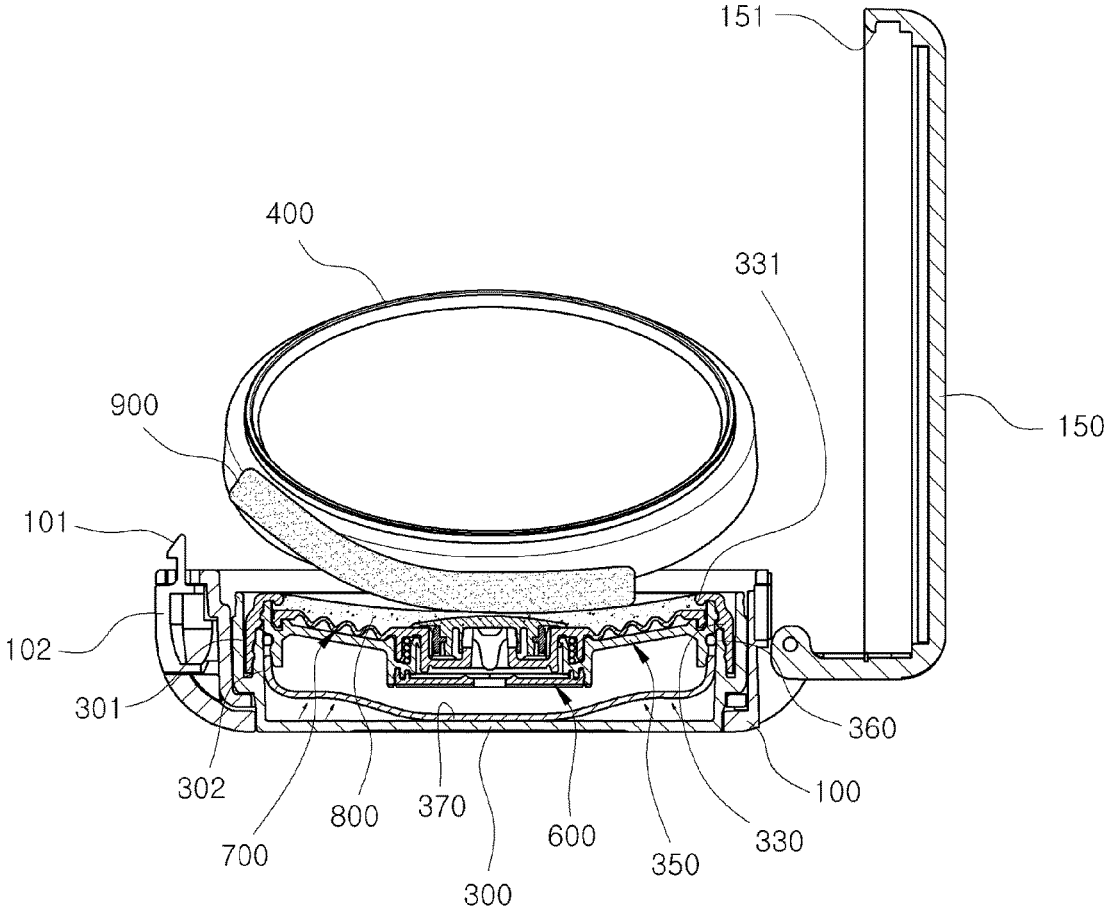
FIG. 9 is a view showing a using state of a foundation container according to the present invention.

Vacuum pressure is also generated as the contents in the auxiliary container 370 are moved into the temporary storage TR of the discharge pump 600 such that the auxiliary container 370 is separated from the inner container body 300 and shrunken as shown in FIG. 9.

According to another embodiment, as shown in FIG. 10, when the plate 371 is mounted in the inner container body 300 instead of the auxiliary container 370 and when the contents are moved into the temporary storage TR of the discharge pump 600 from the inner container body 300, the vacuum pressure is generated and the plate 371 is moved such that the contents are pushed towards the contents suction port 32 of the discharge pump 600.

The contents, which have passed through the contents suction port 32, are moved into the temporary storage TR through the spread gap of the open/close line 41 of the suction valve plate 40. As the contents move, the vacuum pressure disappears from the temporary storage TR. In this case, the open/close line 41, which is open, is recovered to its original state and closed due to the self-elastic force of the suction valve plate 40, which leads the suction valve plate 40 to close the contents suction port 32.

The contents discharged by a discharge action of the discharge pump 600 are moved to the diffusion plate 750 of the contents diffusion member 700. The contents, which are moved into the protrusion 751 and the recess 752 of the diffusion plate 750, are uniformly impregnated into the entire portion of the impregnation member 800. Thereafter, a user may apply the contents, which are impregnated into the impregnation member 800, on the puff 900.

Although a preferred embodiment of the present invention has been described for illustrative purposes in order to replicate the foundation container including the contents diffusion member and the discharge pump having the shorter stroke, the present invention is not limited to the embodiment, and those skilled in the art will appreciate that various modifications, additions and substitutions are possible, without departing from the scope and spirit of the invention as disclosed in the accompanying claims.

Description of Reference Numeral

100: Outer container main body
150: Outer container lid
300: Inner container main body
310: Hinge pin
320: Sealing supplementary ring
330: Fixing member

350: inner container blocking plate
370: Supplementary container
400: Inner container lid
410: Puff keeping space
420: Puff lid
600: Discharge pump
700: Content diffusion member
750: Diffusion plate
800: Impregnation member
900: Puff

The invention claimed is:

1. A foundation container which comprising a discharge pump having short stroke distance, a content diffusion member, an outer container main body (100), and an outer container lid (150) hinge-coupled to the outer container main body (100) to be opened or closed:

an inner container main body formed in the outer container main body (100);

a supplementary container (370) formed in the inner container main body (300) to contain contents;

an inner container lid (400) for covering an upper part of the inner container main body (300);

an inner container blocking plate (350) coupled to an upper inside of the inner container main body (300);

the discharge pump (600) coupled to a center of the inner container blocking plate (350);

the content diffusion member (700) coupled to the discharge pump (600); and an impregnation member (800) coupled to an upper part of the content diffusion member (700), wherein the discharge pump (600) includes a pump main body (10), a pump upper body (20), a pump lower body (30), an absorption valve plate (40), a discharge valve (50) and an elastic member (60).

2. The foundation container of claim 1, wherein the inner container main body (300) is fittingly coupled to the outer container main body (100), the contents are injected into the supplementary container (370), and the inner container blocking plate (350) is coupled to the upper inside of the inner container main body (300) to seal the inner container main body (300).

3. The foundation container of claim 1, wherein, when a top surface of the pump upper body (20) or the discharge valve (50) of the discharge pump (600) is pressed to move down the pump upper body (20), a volume of a temporary storage space (TR) formed in the pump is reduced to generate pressure in the temporary storage space (TR) so that the absorption valve plate closes a content absorption hole (32), wherein the pump includes a valve protrusion wheel (52) tightly closed to a content outlet (22) of an extension protrusion wheel (26) which is opened by pressure so that the contents in the temporary storage space (TR) pass through a gap formed between the content outlet (22) of the extension protrusion wheel (26) and the valve protrusion wheel (52), wherein, after the contents pass through a flowing path (24) which is a gap between the pump upper body (20) and the discharge valve (50), a discharge pressure is applied to an upper periphery part of the discharge valve (50) so that a gap is formed between an upper surface of the pump upper body (20) and the upper periphery part of the discharge valve (50) and the contents are discharged through the gap, wherein, when the pressure applied onto the top surface of the pump upper body (20) or the discharge pump (50) is removed, the pump upper body (20) moves up due to a restoring force of the elastic member (60) and the temporary storage space (TR) in the pump main body (10) is enlarged so that vacuum pressure is generated to close a gap between the valve protrusion wheel of the discharge valve (50) and the content outlet (22) of the extension protrusion wheel (26), wherein a boundary line of an opening and closing line (41) cracks while a central part of the absorption valve plate (40) is lifted up due to the vacuum pressure so that the contents in the supplementary container (370) are delivered into the temporary storage space (TR) while passing through a gap between the absorption valve plate (40) and the content absorption hole (32), wherein the contents passing through the content absorption hole (32) are delivered into the temporary storage space (TR) through a gap of the opening and closing line (41) of the absorption valve plate (40), and wherein, when the vacuum pressure in the temporary storage space (TR) is removed due to the moving of the contents, the cracked opening and closing line (41) is restored to an original state thereof and closed due to an elastic force of the absorption valve plate (40) so that the absorption valve plate (40) closes the content absorption hole (32).

4. The foundation container of claim 1, wherein the pump main body (10) has an inner wall (11) configured to form a hollow at a center of the pump main body (10), wherein a connecting piece (13) is formed outside the inner wall (11), wherein a bent protrusion wheel (14) is integrally formed on an inner upper side of the inner wall (11), wherein the pump upper body (20) is provided with a vertical wall (21) which is movable up or down while being fitted with the inner wall (11) of the pump main body (10), wherein the pump upper body (20) is provided with an extension protrusion wheel (26) which is formed at a center thereof with the content outlet (22), wherein the vertical wall (21) and the extension protrusion wheel (26) are integrally formed through a lower connecting plate (23), wherein an upper extension piece (28) extends outward from an upper end of the vertical wall (21), wherein the pump lower body (30) is fittingly coupled to a lower side of the pump main body (10) and includes a flat-shaped blocking plate (31) formed at a center thereof with the content absorption hole (32), wherein the absorption valve plate (40) has a flat shape, is coupled between the pump main body (10) and the pump lower body (30), and is provided with a plurality of opening and closing lines (41), wherein the discharge valve (50) is coupled to an upper part of the pump upper body (20) and is provided with a valve protrusion wheel (52) for opening and closing the content outlet (22) of the pump upper body (20), wherein a coupling protrusion wheel (54) coupled to the pump upper body (20) is coupled to an outside of the valve protrusion wheel (52) and is provided between the valve protrusion wheel (52) and a coupling protrusion wheel (54) with a space (53), and wherein the elastic member (60) is placed between the pump main body (10) and the pump upper body (20) to elastically support the pump upper body (20).

5. The foundation container of claim 1, wherein the inner container blocking plate (350) is provided at a center thereof with the pump main body (10), and provided at an upper end thereof with a coupling groove (353) which is fittingly coupled to a coupling protrusion (753) formed on an end of a diffusion plate (750) of the content diffusion member (700).

6. The foundation container of claim 1, wherein the content diffusion member (700) is coupled to the discharge pump (600) and includes a diffusion plate (750) extending from an upper extension piece (28) of the pump upper body (20).

7. The foundation container of claim 2, wherein, when a top surface of the pump upper body (20) or the discharge valve (50) of the discharge pump (600) is pressed to move down the pump upper body (20), a volume of a temporary storage space (TR) formed in the pump is reduced to generate pressure in the temporary storage space (TR) so that the absorption valve plate closes a content absorption hole (32), wherein the pump includes a valve protrusion wheel (52) tightly closed to a content outlet (22) of an extension protrusion wheel (26) which is opened by pressure so that the contents in the temporary storage space (TR) pass through a gap formed between the content outlet (22) of the extension protrusion wheel (26) and the valve protrusion wheel (52), wherein, after the contents pass through a flowing path (24) which is a gap between the pump upper body (20) and the discharge valve (50), a discharge pressure is applied to an upper periphery part of the discharge valve (50) so that a gap is formed between an upper surface of the pump upper body (20) and the upper periphery part of the discharge valve (50) and the contents are discharged through the gap, wherein, when the pressure applied onto the top surface of the pump upper body (20) or the discharge pump (50) is removed, the pump upper body (20) moves up due to a restoring force of the elastic member (60) and the temporary storage space (TR) in the pump main body (10) is enlarged so that vacuum pressure is generated to close a gap between the valve protrusion wheel of the discharge valve (50) and the content outlet (22) of the extension protrusion wheel (26), wherein a boundary line of an opening and closing line (41) cracks while a central part of the absorption valve plate (40) is lifted up due to the vacuum pressure so that the contents in the supplementary container (370) are delivered into the temporary storage space (TR) while passing through a gap between the absorption valve plate (40) and the content absorption hole (32), wherein the contents passing through the content absorption hole (32) are delivered into the temporary storage space (TR) through a gap of the opening and closing line (41) of the absorption valve plate (40), and wherein, when the vacuum pressure in the temporary storage space (TR) is removed due to the moving of the contents, the cracked opening and closing line (41) is restored to an original state thereof and closed due to an elastic force of the absorption valve plate (40) so that the absorption valve plate (40) closes the content absorption hole (32).

8. The foundation container of claim 2, wherein the pump main body (10) has an inner wall (11) configured to form a hollow at a center of the pump main body (10), wherein a connecting piece (13) is formed outside the inner wall (11), wherein a bent protrusion wheel (14) is integrally formed on an inner upper side of the inner wall (11), wherein the pump upper body (20) is provided with a vertical wall (21) which is movable up or down while being fitted with the inner wall (11) of the pump main body (10), wherein the pump upper body (20) is provided with an extension protrusion wheel (26) which is formed at a center thereof with the content outlet (22), wherein the vertical wall (21) and the extension protrusion wheel (26) are integrally formed through a lower connecting plate (23), wherein an upper extension piece (28) extends outward from an upper end of the vertical wall (21), wherein the pump lower body (30) is fittingly coupled to a lower side of the pump main body (10) and includes a flat-shaped blocking plate (31) formed at a center thereof with the content absorption hole (32), wherein the absorption valve plate (40) has a flat shape, is coupled between the pump main body (10) and the pump lower body (30), and is provided with a plurality of opening and closing lines (41), wherein the discharge valve (50) is coupled to an upper part of the pump upper body (20) and is provided with a valve protrusion wheel (52) for opening and closing the content outlet (22) of the pump upper body (20), wherein a coupling protrusion wheel (54) coupled to the pump upper body (20) is coupled to an outside of the valve protrusion wheel (52) and is provided between the valve protrusion wheel (52) and a coupling protrusion wheel (54) with a space (53), and wherein the elastic member (60) is placed between the pump main body (10) and the pump upper body (20) to elastically support the pump upper body (20).

9. The foundation container of claim 2, wherein the inner container blocking plate (350) is provided at a center thereof with the pump main body (10), and provided at an upper end thereof with a coupling groove (353) which is fittingly coupled to a coupling protrusion (753) formed on an end of a diffusion plate (750) of the content diffusion member (700).

10. The foundation container of claim 2, wherein the content diffusion member (700) is coupled to the discharge pump (600) and includes a diffusion plate (750) extending from an upper extension piece (28) of the pump upper body (20).

11. The foundation container of claim 6, wherein the extension plate (750) of the content diffusion member (700) is integrated with the pump upper body (20) of the discharge pump (600).

12. The foundation container of claim 6, wherein the diffusion plate (750) includes a protrusion part (751), a concaved groove (752) and a coupling protrusion (753).

13. The foundation container of claim 6, wherein the diffusion plate (750) extends from an upper extension piece (28) of the pump upper body (20) and a diffusion passage (755) through which the contents are diffused is formed on a content passage plate (754).

14. The foundation container of claim 10, wherein the extension plate (750) of the content diffusion member (700) is integrated with the pump upper body (20) of the discharge pump (600).

15. The foundation container of claim 10, wherein the diffusion plate (750) includes a protrusion part (751), a concaved groove (752) and a coupling protrusion (753).

16. The foundation container of claim 10, wherein the diffusion plate (750) extends from an upper extension piece (28) of the pump upper body (20) and a diffusion passage (755) through which the contents are diffused is formed on a content passage plate (754).

17. The foundation container of claim 12, wherein the protrusion part (751) and the concaved groove (752) have a circular shape and are repeatedly formed about the pump upper body (20).

18. The foundation container of claim 15, wherein the protrusion part (751) and the concaved groove (752) have a circular shape and are repeatedly formed about the pump upper body (20).

* * * * *